US012055145B2

(12) United States Patent
Picouet et al.

(10) Patent No.: US 12,055,145 B2
(45) Date of Patent: Aug. 6, 2024

(54) SELF-POSITIONING VOLUME SLIDE VALVE FOR SCREW COMPRESSOR

(71) Applicant: Copeland Industrial LP, Cudahy, WI (US)

(72) Inventors: Jean-Louis Picouet, Waukesha, WI (US); Steven Fels, Cudahy, WI (US)

(73) Assignee: Copeland Industrial LP, Cudahy, WI (US)

( * ) Notice: Subject to any disclaimer, the term of this patent is extended or adjusted under 35 U.S.C. 154(b) by 0 days.

(21) Appl. No.: 17/869,323

(22) Filed: Jul. 20, 2022

(65) Prior Publication Data

US 2023/0027313 A1 Jan. 26, 2023

Related U.S. Application Data

(60) Provisional application No. 63/238,836, filed on Aug. 31, 2021, provisional application No. 63/224,253, filed on Jul. 21, 2021.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 18/52*** | (2006.01) |
| ***F04C 28/12*** | (2006.01) |

(52) U.S. Cl.

CPC ..... *F04C 28/12* (2013.01); *F04C 18/52* (2013.01); *F04C 28/125* (2013.01)

(58) Field of Classification Search

CPC ..... F04C 18/16; F04C 18/48; F04C 18/54; F04C 18/56; F04C 28/12; F04C 28/125; F04C 18/52; F16K 3/314; F16K 3/316; F16K 3/34

See application file for complete search history.

(56) References Cited

U.S. PATENT DOCUMENTS

| | | | | |
|---|---|---|---|---|
| 774,551 | A | 11/1904 | Beaumont | |
| 3,088,659 | A | 5/1963 | Nilsson et al. | |
| 3,108,740 | A | 10/1963 | Schibbye | |
| 3,151,806 | A | 10/1964 | Whitfield | |
| 3,314,597 | A | 4/1967 | Schibbye | |
| 3,756,753 | A | 9/1973 | Persson et al. | |
| 3,810,715 | A | 5/1974 | Week et al. | |
| 3,936,239 | A * | 2/1976 | Shaw | F04C 28/125 418/201.2 |
| RE29,283 | E | 6/1977 | Shaw | |
| 4,220,197 | A * | 9/1980 | Schaefer | B60H 1/3204 165/263 |
| 4,261,691 | A | 4/1981 | Zimmern et al. | |
| 4,455,131 | A | 6/1984 | Werner-Larson | |

(Continued)

FOREIGN PATENT DOCUMENTS

| | | |
|---|---|---|
| JP | 57195889 | 12/1982 |
| WO | 2006085866 | 8/2006 |

*Primary Examiner* — Theresa Trieu

(74) *Attorney, Agent, or Firm* — Amundsen Davis, LLC

(57) ABSTRACT

Dual slide valve assemblies having volume slide valve members that are self-positioning. The slide valve assemblies include a self-positioning volume slide valve mechanism that automatically slidably adjusts to control compressor volume ratio and power input to the compressor. The slide valve assemblies also include a capacity slide valve mechanism that is slidably movable to control compressor capacity.

16 Claims, 10 Drawing Sheets

(56) References Cited

U.S. PATENT DOCUMENTS

| | | | |
|---|---|---|---|
| 4,478,054 | A | 10/1984 | Shaw |
| 4,583,373 | A | 4/1986 | Shaw |
| 4,597,726 | A | 7/1986 | Soderlund |
| 4,610,612 | A | 9/1986 | Kocher |
| 4,610,613 | A | 9/1986 | Szymaszek |
| 4,611,976 | A | 9/1986 | Schibbye et al. |
| 4,704,069 | A | 11/1987 | Kocher et al. |
| 4,842,501 | A | 6/1989 | Schibbye |
| 5,435,704 | A | 7/1995 | Sawyer |
| 6,106,241 | A | 8/2000 | Zimmern |
| 7,798,793 | B2 | 9/2010 | Shoulders |
| 7,891,955 | B2 | 2/2011 | Picouet |
| 8,202,060 | B2 | 6/2012 | Picouet |
| 2006/0008375 | A1 | 1/2006 | Hasegawa |
| 2008/0206075 | A1 | 8/2008 | Picouet |
| 2010/0284848 | A1 | 11/2010 | Fujiwara et al. |

* cited by examiner

SELF-POSITIONING VOLUME SLIDE VALVE FOR SCREW COMPRESSOR

FIELD OF THE INVENTION

The present technology relates to compressors and slide valve assemblies for compressors, and more particularly to slide valve assemblies having a self-positioning volume slide valve member.

BACKGROUND

Compressors (e.g., rotary screw gas compressors) are used, for example, in compression systems (e.g., refrigeration systems) to compress refrigerant gas, such as "Freon", ammonia, natural gas, or the like. One type of rotary gas compressor employs a housing in which a motor-driven single main rotor having spiral grooves thereon that mesh with a pair of gate or star rotors on opposite sides of the rotor to define gas compression chambers. The housing is provided with two gas suction ports (one near each gate rotor) and with two gas discharge ports (one near each gate rotor). Two dual slide valve assemblies are provided on the housing (one assembly near each gate rotor) and each slide valve assembly comprises a suction slide valve (also referred to as a "capacity slide valve") and a discharge slide valve (also referred to as a "volume slide valve"), for controlling an associated suction port and an associated discharge port, respectively. Generally, the capacity slide valves and the volume slide valves are moved independently by actuators, such as, for example, electrical or hydraulic actuators/motors. U.S. Pat. Nos. 4,610,612, 4,610,613, 4,704,069, 7,891,955, and 8,202,060, all of which are assigned to the same assignee as the present application, disclose a dual-slide valve rotary gas compressor of the kind described above. The teachings and disclosures of each of these patents are incorporated by reference in their entireties herein.

During operation of such single screw compressors, a small amount of oil is continuously supplied to the compression chambers to provide an oil seal at points where the main rotor meshes with the gate rotors and with the housing to thereby effectively seal the chambers against gas leakage during gas compression. The oil flows out through the discharge ports and is recovered and recirculated. When the compressor is shut down and coasting to rest, excess oil can collect or settle in the compression chambers. When the compressor is restarted, the residual oil in the compression chambers, plus fresh oil entering the compression chambers, must be expelled through the discharge ports. In certain instances where the compressor is started with too much liquid in it, there is considerable pressure generated into the grooves of the screw because they grooves are attempting to compress a non-compressible fluid instead of the compressible refrigerant gas. Such a situation is generally known "liquid lock," which can cause degradation of the performances of the compressor, and sometimes results in the compressor stalling because the motor cannot turn the screw.

A compressor 10 having a dual slide assembly 12, of the type shown in U.S. Pat. No. 7,891,955, is illustrated in FIG. 1 (Prior Art). Specifically, FIG. 1 shows the mechanisms for moving the slide valves 14 and 16 are shown in FIG. 1. The assembly 12 includes rackshaft 18 which includes rack teeth 20 thereon. Pinion gear 22 engages rack teeth 20 on the side of slide rackshaft 18 which has one end rigidly secured to the end edge 24 of the slide valve member 14 of the slide valve assembly 12. Similarly, slide valve member 16 is moved using rackshaft 26. Rackshaft 26 includes rack teeth 28 thereon, and pinion gear 30 engages the rack teeth on the side of the rod which has an end rigidly secured to the end edge 32 of slide member 16. Actuator mechanisms (not shown) are connected to each of the pinion gears 22 and 30 and are used to effect the slide valve movement the slide valves 14 and 16.

Each dual-purpose capacity and volume slide valve member 14, 16 is slidably positionable (between full load and part load positions) relative to the port 36 to control where low pressure uncompressed gas from gas inlet passage 38 is admitted to the compression chambers or grooves of main rotor to thereby function as a suction by-pass to control compressor capacity. Each volume slide valve member 16 is slidably positionable (between minimum and adjusted volume ratio positions) relative to the discharge/volume port 40 to control where, along the compression chambers or grooves, high pressure compressed gas is expelled from the compression chambers, through discharge/volume port 40 to gas exhaust passage to thereby control the input power to the compressor. The slide valve members 14 and 16 are independently movable by the separate actuators (not shown) that are connected to pinion gears 22 and 30. A known control means or system is used to cause the actuators to position the slide valves 14 and 16 for compressor start-up. The control means or system operates the actuators to position and reposition the slide valve members 14 and 16, as needed, to cause the compressor to operate at a predetermined capacity and a predetermined power input.

As can be seen in FIG. 1, typical slide valve assemblies use one or more actuators connected to pinion gears in combination with shafts, gears and a rackshaft to control the position of each of the capacity slide valve member 14 and the volume slide valve member 16. The actuators are programmed to position the valve members based on a number of factors, including for example, the compressor capacity (0 to 100%) and the internal pressures (suction and discharge).

FIG. 2 shows a perspective view of another example of a carriage and slide valve members of a prior art slide valve assembly 100. The slide valve assembly 100 includes a carriage 102, as well as two movable slide valve members or mechanisms, namely, a capacity slide valve member 104 and a volume slide valve member 106. The capacity slide valve member 104 is connected to a first rackshaft 110, which is driven by an actuator (not shown) to move the capacity slide valve member 104 along its axis of movement to a desired position. The volume slide valve member 106 is connected to a second rackshaft 108, which is driven by an actuator (not shown) to move the volume slide valve member 106 along its axis of movement to a desired position.

BRIEF DESCRIPTION OF THE DRAWINGS

Specific examples have been chosen for purposes of illustration and description, and are shown in the accompanying drawings, forming a part of the specification.

DETAILED DESCRIPTION

Slide valve assemblies of the present technology are generally intended for use in a variety of compressors. One exemplary compressor is a single rotary screw gas compressor adapted for use in a compression system (e.g., a refrigeration system), or the like.

Figure 1:
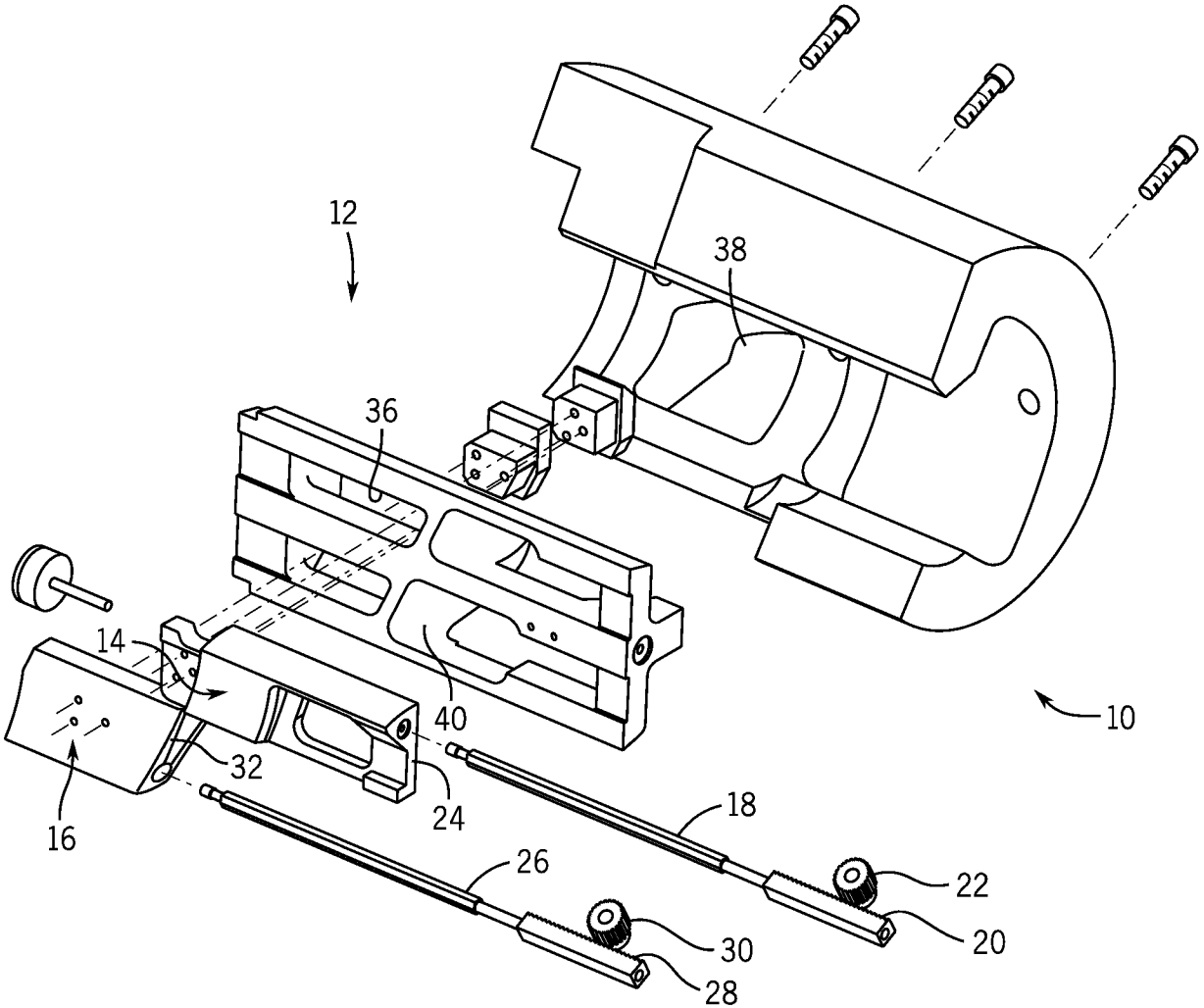
FIG. 1 (PRIOR ART)
FIG. 1 in an exploded view of one example prior art slide valve assembly showing the mechanisms for moving the slide valves.
Figure 2:
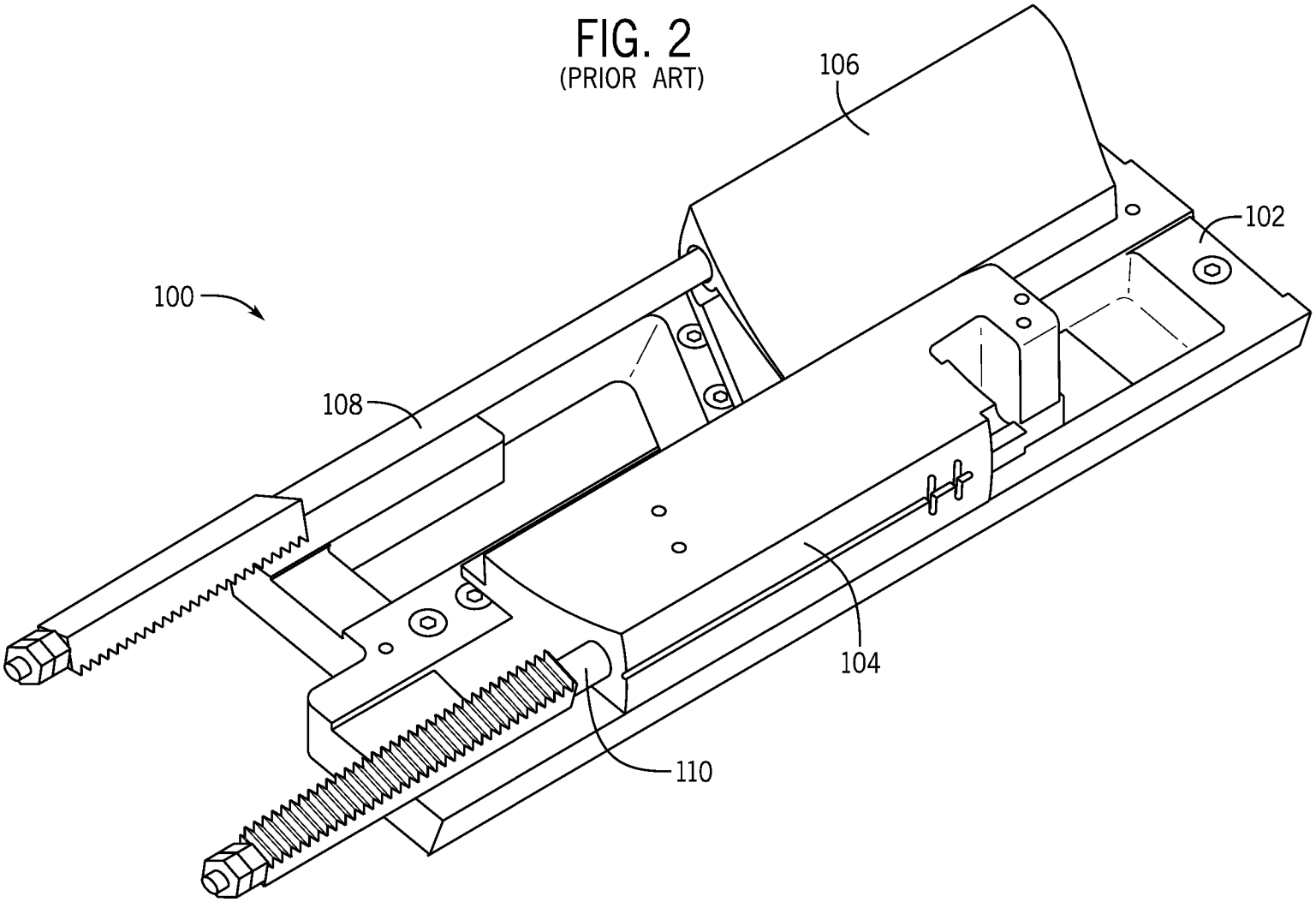
FIG. 2 (PRIOR ART)
FIG. 2 is a top perspective view of one example of a carriage and slide valve members of a prior art slide valve assembly.
Figure 3:
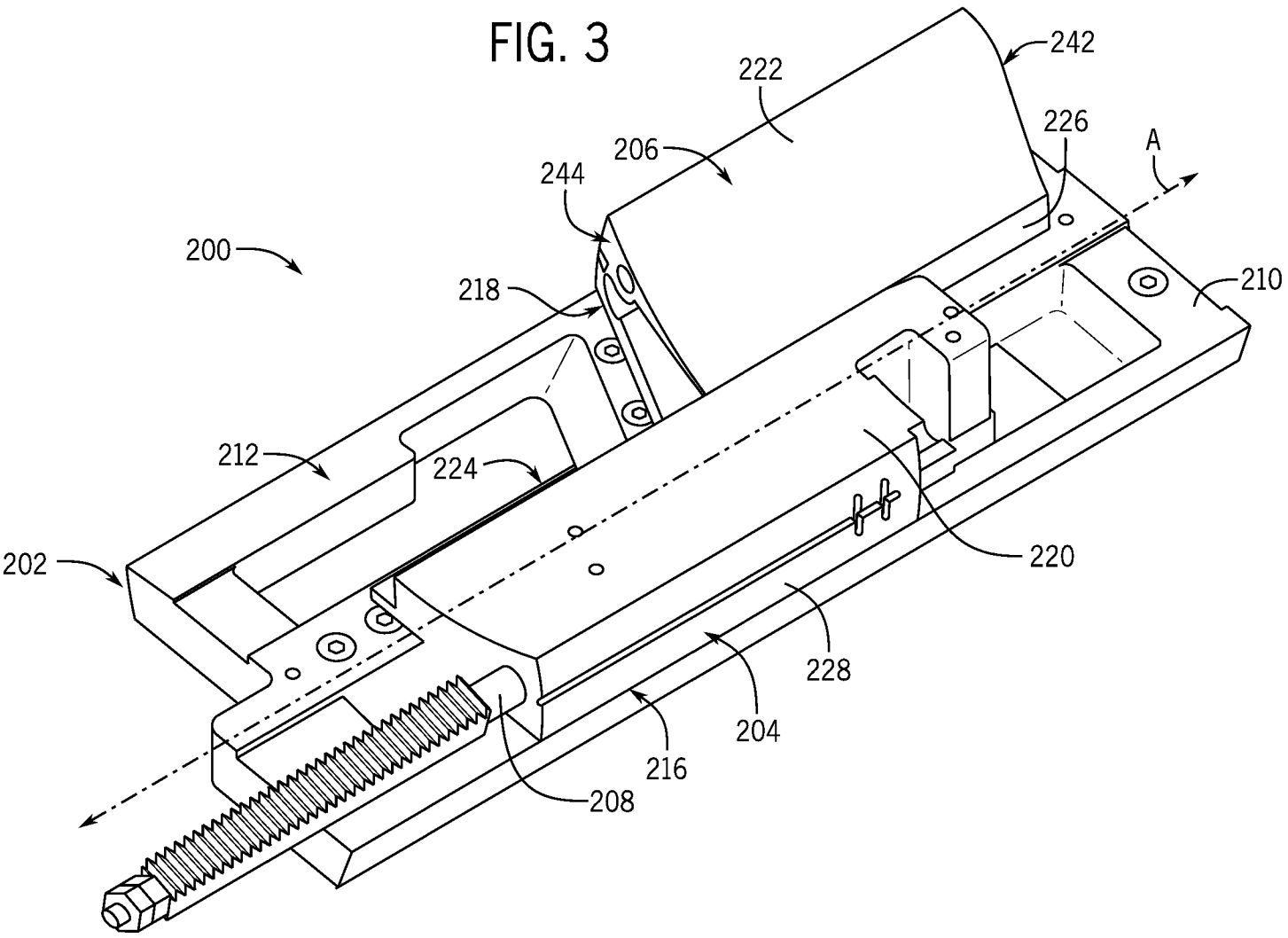
FIG. 3 is a top perspective view of one example of a carriage and slide valve members of a slide valve assembly of the present technology.
Figure 4:
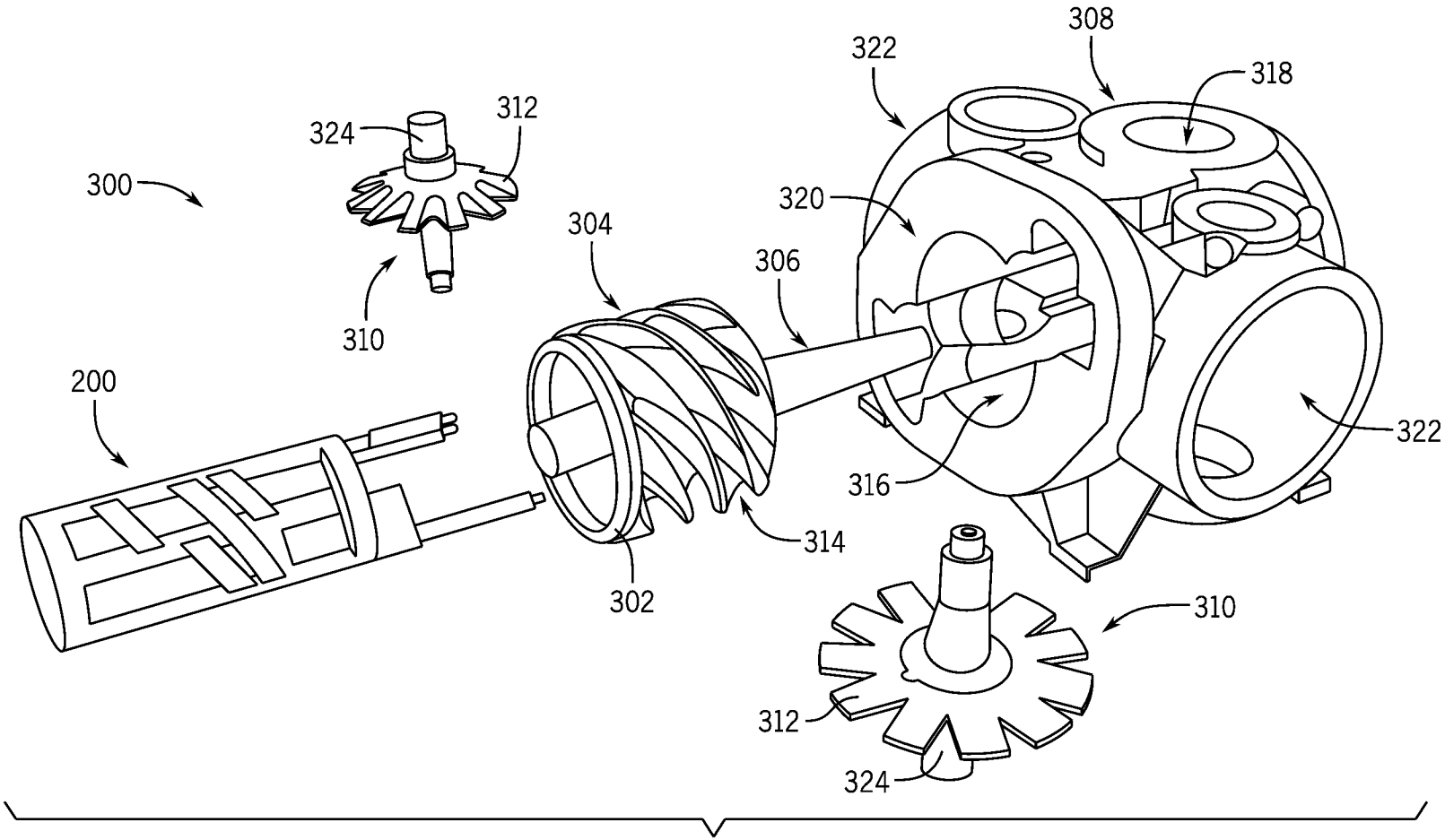
FIG. 4 is an exploded view of a single screw compressor including the slide valve assembly of FIG. 3.
Figure 5:
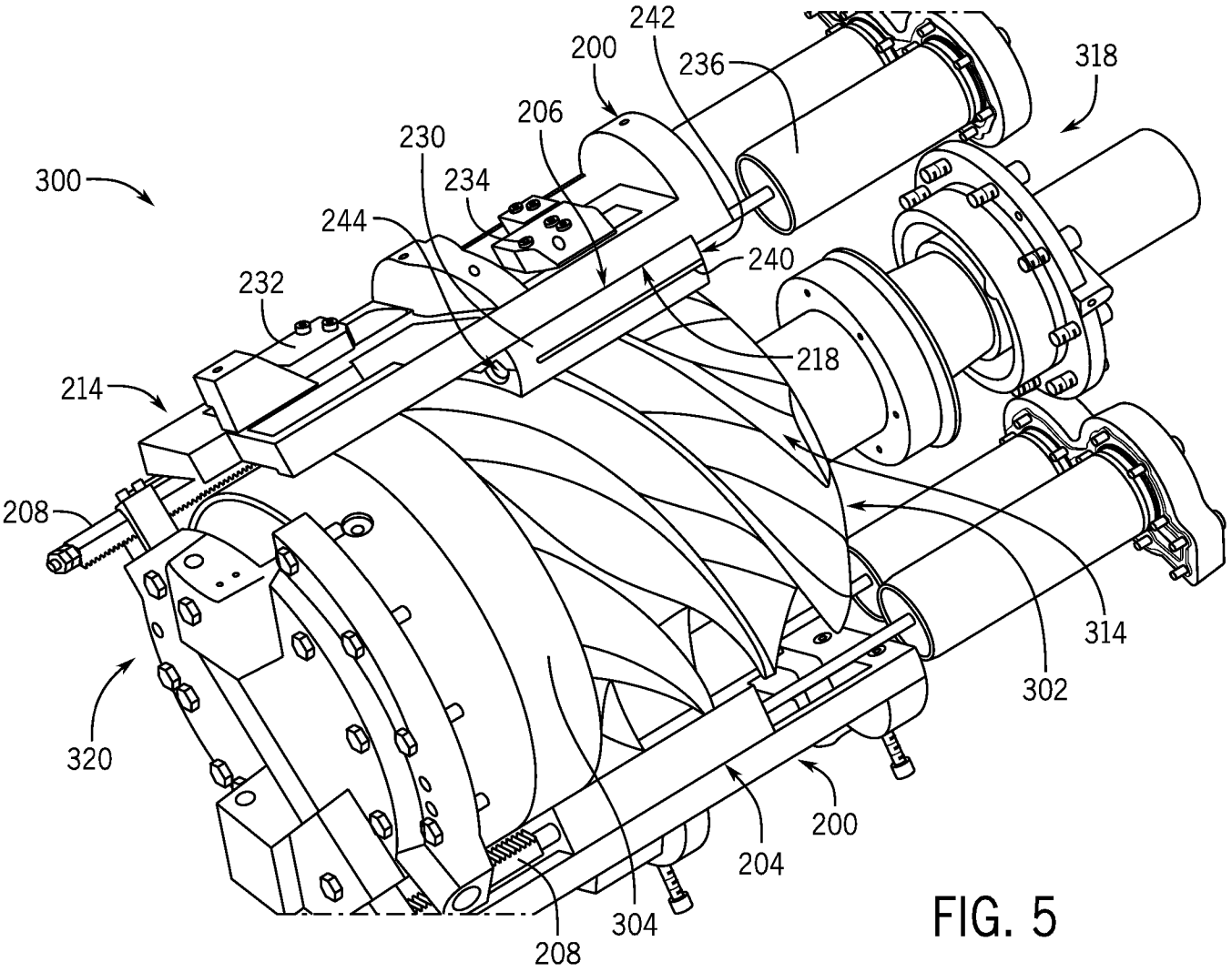
FIG. 5 is a perspective view of a portion of the compressor of FIG. 4.

FIGS. 3-5 illustrate of one example of a compressor 300 that includes slide valve assemblies 200 of the present technology. The compressor 300 is a rotary gas compressor for a refrigeration system, and is specifically a single screw rotary gas compressor.

As shown in FIGS. 4 and 5, the compressor 300 has a helically grooved main rotor 302 that has a cylindrical outer surface 304 and a rotor shaft 306. Compressor 300 also includes a compressor housing 308, and the main rotor 302 is mounted for rotation about a rotor axis (not shown) within the compressor housing 308. A pair of star-shaped gate rotors 310, or star rotors, are also mounted for rotation in the compressor housing 308. Each gate rotor 310 has a plurality of gear teeth 312 that are configured to mesh with the helical grooves 314 of the main rotor 302. Compressor 300 includes two slide valve assemblies 200, which are generally mounted inside the compressor housing 308 and are cooperable with the main rotor 302 to control gas flow into and from the compression chambers formed by the helical grooves 314 on the main rotor 302.

The compressor housing 308 generally includes a cylindrical bore 316 in which the main rotor is rotatably mounted. The cylindrical bore 316 may be open at its suction end 318 and may be closed at its discharge end 320 by a discharge end wall (not shown). The rotor shaft 306 of the main rotor 302 is rotatably supported at opposite ends on bearing assemblies (not shown) mounted on compressor housing 308. The compressor housing 308 typically includes spaces 322 therein in which the star rotors 310 are rotatably mounted and the gate rotors 310 are located on opposite sides (i.e., 180 degrees apart) of main rotor 302. Each of the gate rotors 310 has a plurality of gear teeth 312 and is provided with a gate rotor shaft 324 which is rotatably supported at opposite ends on the bearing assemblies (not shown) mounted on the compressor housing 308. Each of the gate rotors 310 typically rotate on an axis which is perpendicular to and spaced from the axis of rotation of main rotor 302 and its gear teeth 312 extend through an opening communicating with cylindrical bore 316. During operation, each gear tooth 312 of each of the gate rotors 310 successively engages a groove in main rotor 302 as the latter is rotatably driven by a motor and, in cooperation with the wall of cylindrical bore 316 and specifically its end wall (not shown), defines a gas compression chamber.

In contrast to currently known slide valve assemblies, slide valve assemblies of the present technology include volume slide valve members that are not driven by an actuator. Instead, the volume slide valve members in slide valve assemblies of the present technology are self-positioning. As used herein, "self-positioning" means that the slide valve member moves solely in response to differences in pressure between the groove pressure and the discharge pressure. For example, volume slide valve assemblies of the present technology do not include an actuator or other position controlling apparatus connected to the volume slide valve member. The slide valve assemblies of the present technology may also operate without other mechanical driving components associated with the volume slide valve member, such as a rackshaft, as well as an electrical actuator and the cables and software related to the actuator.

As best shown in FIG. 3, a slide valve assembly 200 of the present technology includes a slide valve carriage 202, as well as two movable slide valve members, namely, a capacity slide valve member 204 and a volume slide valve member 206. Each of the movable slide valve members is slidably secured to the slide valve carriage 202, and is slidably movable longitudinally, or axially, with respect to the carriage 202, parallel to the schematic axis of axial movement A. The volume slide valve member 206 and the capacity slide valve member 204 are independently movable. The volume slide valve member 206 is self-positioning, and automatically slidably adjusts its position to control compressor volume ratio and power input to the compressor. The capacity slide valve mechanism 204 is slidably movable by a controller to control compressor capacity. More specifically, the capacity slide valve member 204 is connected to a first rackshaft 208, which is driven by an actuator (not shown) to move the capacity slide valve member 204 along its axis of movement to a desired position. The volume slide valve member 206 is not connected to a rackshaft, and is also not connected to an actuator. The position of the volume slide valve member is thus not driven by an actuator.

Referring to FIGS. 3, 4 and 5, carriage 202 includes a rectangular plate portion 210 having a front side 212 and a rear side 214. The capacity slide valve member 204 has a rear surface 216, which may be flat and smooth. The volume slide valve member 206 has a rear surface 218, which may be flat and smooth, and may include one or more bottom grooves. The capacity slide valve member 204 has a front surface 220 and the volume slide valve member 206 has a front surface 222. Front surfaces 220 and 222 can each be curved or contoured, and can also be smooth or substantially smooth. The capacity slide valve member 204 and the volume slide valve member 206 can also include inside surfaces 224 and 226, respectively, which can each be flat and smooth or substantially smooth. The capacity slide valve member 204 and the volume slide valve member 206 can further include outside surfaces 228 and 230, respectively, which can each be contoured or curved and smooth or substantially smooth. The volume slide valve member 206 also has a first end surface 242 that faces the suction end 318 of the compressor 300, and a second end surface 244 that faces the discharge end 320 of the compressor 300. The volume slide valve member 206 can also include a volume low pressure outside groove 240 that can be formed or otherwise created in, and extend across a substantial portion of, or almost the entire extent of, an outside surface of the volume slide valve member 206.

The rear surface 216 of the capacity slide valve member 204 and the rear surface 218 of the volume slide valve member 206 each face towards and slide upon the front side 212 of the rectangular plate portion 210 of carriage 202. Front surface 220 of the capacity slide valve member 204 and front surface 222 of the volume slide valve member 206 each face towards the cylindrical surface 304 of the main rotor 302 (FIGS. 4 and 5). The inside surface 224 of the capacity slide valve member 204 and the inside surface 226 of the volume slide valve member 206 can slidably engage each other. The outside surface 228 of the capacity slide valve member 204 and the outside surface 230 of the volume slide valve member 206 can face towards and slidably engage a compressor structure, such as an inside wall of cylindrical bore 316 (FIG. 4). The capacity slide valve member 204 and the volume slide valve member 206 can be slidably secured to carriage 202, such as by capacity clamping member 232 and volume clamping member 234, which may be secured to the slide valve members by fasteners, such as screws or any other suitable type of fastener.

During operation, different portions of the volume slide valve member 206 are in contact with compression gasses at various stages of compression, and the compression gasses at those various stages of compression act on the portion of the volume slide valve member 400 that they contact. Referring to FIG. 5, initial compression gasses at suction pressure enter the main rotor 302 at the suction end 318. As the compression gasses travel through the compression chambers formed by the helical grooves 314, they become intermediate compression gasses, which have an increasing pressure as they travel from the suction end 318 towards the discharge end 320. When the compression gasses exit the helical grooves 314 they are discharge gasses and have a pressure that is discharge pressure. The gasses around the outside of the main rotor 302 and the initial compression gasses are at suction pressure, and therefore exert a force known as "suction pressure" on portions of the volume slide valve member 206. The discharge gasses that are discharged from the helical grooves 314 exert a force known as "discharge pressure" on portions of the volume slide valve member 206. The intermediate compression gasses, which have an increasing pressure as they travel from the suction end 318 towards the discharge end 320 exert a force known as "groove pressure" on portions of the volume slide valve member 206.

The compressor 300 is configured to provide balanced opposing pressures along the axial axis of movement of the volume slide valve member 206, which is in the axial direction of the compressor 300. Specifically, a first discharge pressure force is exerted on the second end surface 244 of the volume slide valve member 206 by the discharge gasses. To balance that first discharge pressure force, the slide valve assembly 200 includes a balance piston 236, which has an internal connection to the discharge gas (not shown). The balance piston 236 exerts a second discharge pressure force on the first end surface 242 of the volume slide valve member 206, and the second discharge pressure force is equal to the first discharge pressure force.

Figure 6:
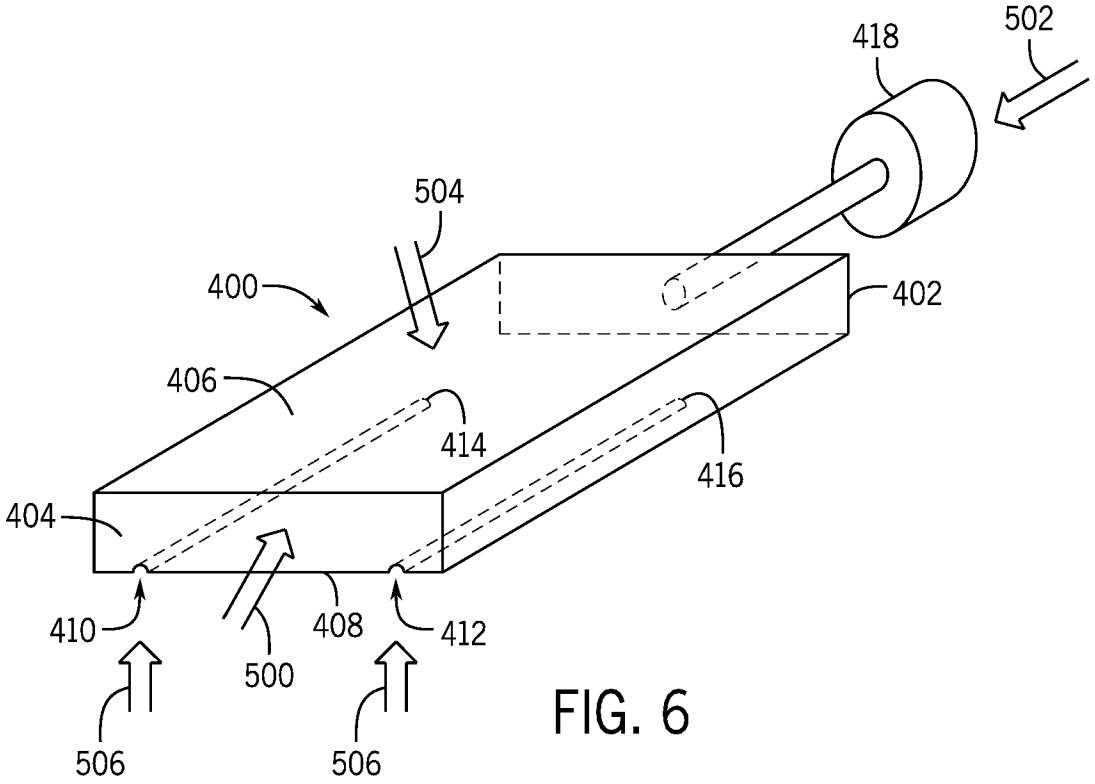
FIG. 6 illustrates a system having a simplified representation of a volume slide member and the forces that act on the volume slide member during operation.

The forces acting on the volume slide valve member in a slide valve assembly 200 of the present technology, in both the axial and radial directions, can best be seen in FIG. 6. FIG. 6 illustrates a simplified version of a volume slide valve member 400, with the forces that act on the volume slide during operation. It should be understood that in an actual compressor, the volume slide valve member 400 can have any of the features (e.g., grooves and/or surfaces) of volume slide valve member 206 as described above, and the volume slide valve member 206 can have any of the features (e.g., grooves and/or surfaces) described with respect to volume slide valve member 400.

As shown in FIG. 6, the volume slide valve member 400 has a first end surface 402, a second end surface 404, a front surface 406 and a rear surface 408. The rear surface 408 of the volume slide valve member 400 may have one or more bottom grooves, such as first bottom groove 410 and second bottom groove 412. Each of the bottom grooves may extend along a portion of the length of the rear surface 408 of the volume slide valve member 400. In FIG. 6, the first bottom groove 410 extends along a portion of the length of the rear surface 408 of the volume slide valve member 400 and has a first terminal end 414, and second bottom groove 412 extends along a portion of the length of the rear surface 408 of the volume slide valve member 400 and has a terminal end 416.

The compressor (which may be compressor 300) is configured to provide balanced pressures along the axial axis of movement the volume slide valve member 400. Specifically, a first discharge pressure force 500 is exerted on the second end surface 404 of the volume slide valve member 400 by the discharge gasses. To balance that first discharge pressure force, the slide valve assembly includes a balance piston 418, which has an internal connection to the discharge gas (not shown). The balance piston 418 exerts a second discharge pressure force 502 on the first end surface 402 of the volume slide valve member 400, and the second discharge pressure force 502 is equal to the first discharge pressure force 500.

In a radial direction, which is perpendicular to the axial direction, there is a groove pressure force 504 acting on the front surface 406 of the volume slide member 400, which is generated by the intermediate gasses. There is a countering pressure force 506, which is equal to the discharge pressure and acts within the one or more bottom grooves, which may be first bottom groove 410 and second bottom groove 412. For example, discharge gasses contacting the second end surface 404 may enter the one or more bottom grooves and thus provide the countering force 506.

Since the forces applied to the volume slide member 400 are designed to be balanced when the compressor is operating in a state of ideal compression, a slight change in the groove pressure due to an incorrect volume slide location will induce a different pressure near the second end surface 404, which will create an unbalanced system. In response, the volume slide member 400 will self-position by moving due to the unbalanced forces, until the groove pressure is identical to the discharge pressure, resulting in an ideal position/compression in all cases at any conditions.

Figure 7:
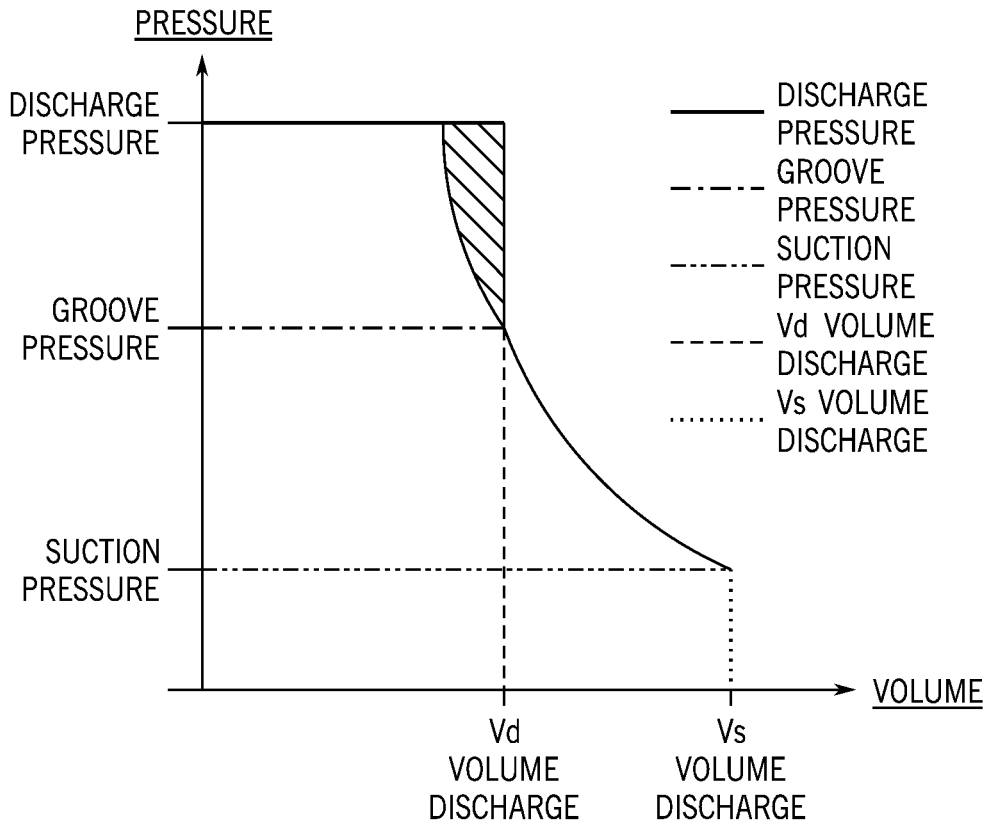
FIG. 7 illustrates a graph of Volume versus pressure during under compression that may occur with respect to the system of FIG. 6.
Figure 8:
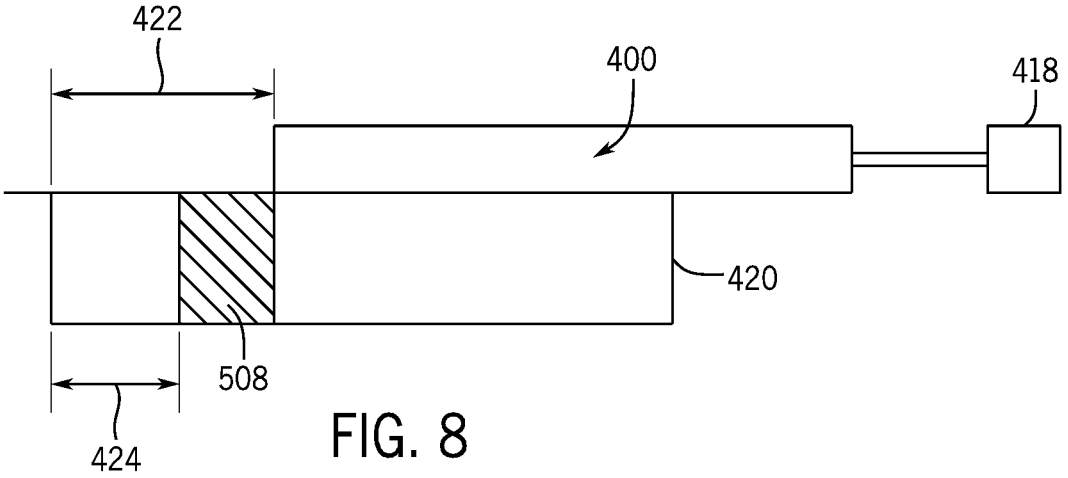
FIG. 8 illustrates a two-dimensional representation of under compression that may occur with respect to the system of FIG. 6.
Figure 9:
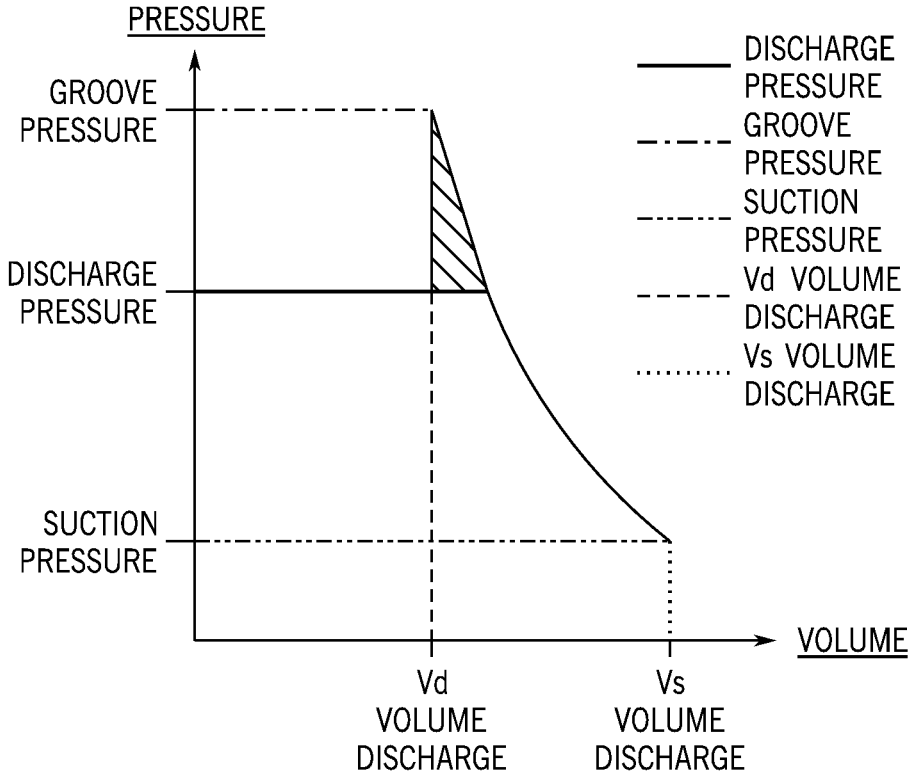
FIG. 9 illustrates a graph of Volume versus pressure during over compression that may occur with respect to the system of FIG. 6.
Figure 10:
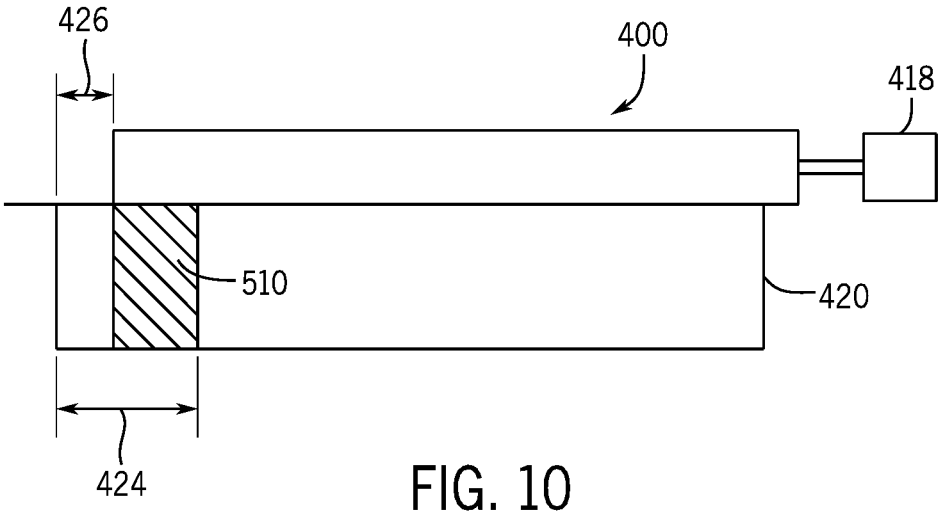
FIG. 10 illustrates a two-dimensional representation of over compression that may occur with respect to the system of FIG. 6.
Figure 11:
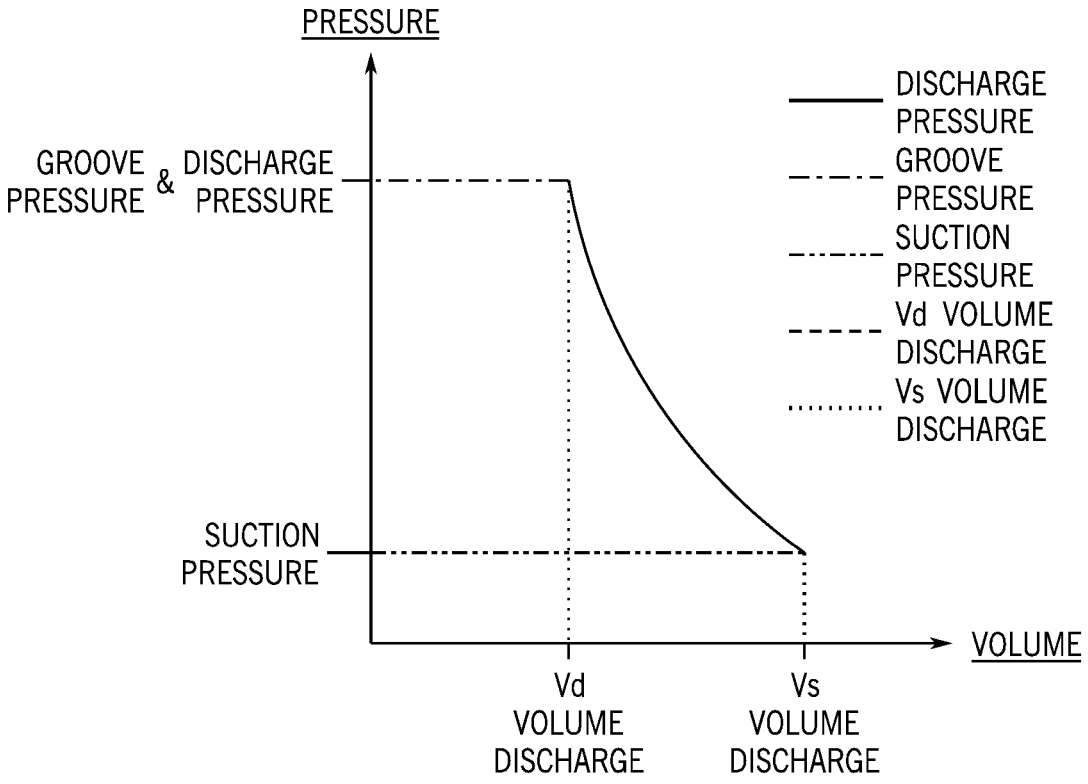
FIG. 11 illustrates a graph of Volume versus pressure during ideal compression that may occur with respect to the system of FIG. 6.
Figure 12:
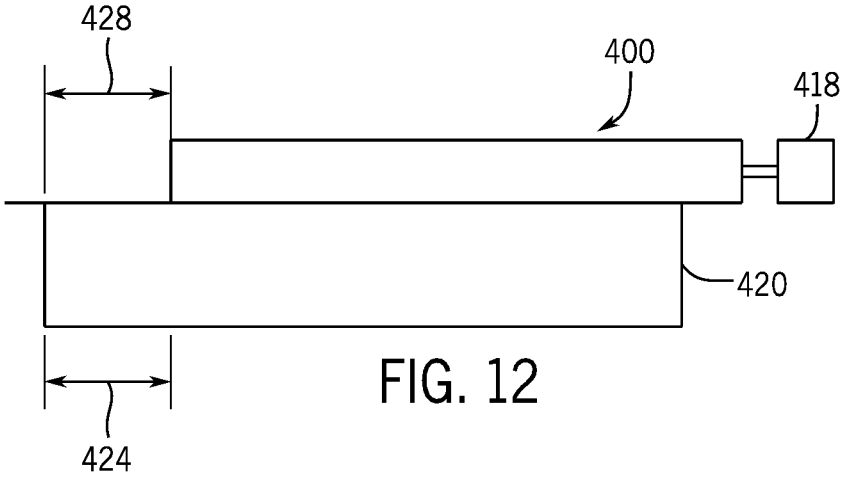
FIG. 12 illustrates a two-dimensional representation of ideal compression that may occur with respect to the system of FIG. 6.

FIGS. 7, 9 and 11 provide graphs of Volume versus Pressure during three different operational circumstances, under compression, over compression, and idea compression. FIGS. 8, 10 and 12 are two-dimensional representations of forces acting on the volume slide member 400 during each of the different operational circumstances of FIGS. 7, 9 and 11, respectively.

Referring to FIGS. 7 and 8, under compression occurs when the groove pressure is less than the discharge pressure. As seen in FIG. 7, there is lost energy, represented by the cross-hatched area between the Discharge Pressure and the Groove Pressure. As seen in FIG. 8, when under compression occurs, the volume slide member 400 is too far to the right, and will thus self-position by moving to the left until the groove pressure equals the discharge pressure. As shown, the volume slide valve member 400 is positioned too far to the right (towards the section end) above groove 420, and has a first outlet port width 422. The ideal outlet port width 424 would be where the groove pressure equals the discharge pressure, but the first outlet port width 422 is greater than the ideal outlet port width 424, resulting in lost energy 508 because the groove pressure is less than the discharge pressure. Accordingly, the volume slide valve member 400 will self-position by sliding axially to the left, towards the discharge end, until the first outlet port width 422 is equal to the ideal outlet port width 424.

Referring to FIGS. 9 and 10, over compression occurs when the groove pressure is greater that the discharge pressure. As seen in FIG. 9, there is lost energy, represented by the cross-hatched area between the Discharge Pressure and the Groove Pressure. As seen in FIG. 10, when under compression occurs, the volume slide member 400 is too far to the left, and will thus self-position by moving to the right until the groove pressure equals the discharge pressure. As shown, the volume slide valve member 400 is positioned too far to the left (towards the discharge end) above groove 420, and has a second outlet port width 426. The ideal outlet port width 424 would be where the groove pressure equals the discharge pressure, but the second outlet port width 426 is less than the ideal outlet port width 424, resulting in lost energy 510 because the groove pressure is greater than the discharge pressure. Accordingly, the volume slide valve member 400 will self-position by sliding axially to the right, towards the suction end, until the second outlet port width 426 is equal to the ideal outlet port width 424.

Referring to FIGS. 11 and 12, ideal compression occurs when the forces acting on the volume slide member 400 are balanced, and the groove pressure equals the discharge pressure. As seen in FIG. 11, there is no area of lost energy. As shown in FIG. 12, the volume slide valve member 400 is positioned so that the actual outlet port width 428 is equal to the ideal outlet port width 424, where the groove pressure equals the discharge pressure. Accordingly, there is no lost energy and the volume slide member 400 will hold its current position.

Figure 13:
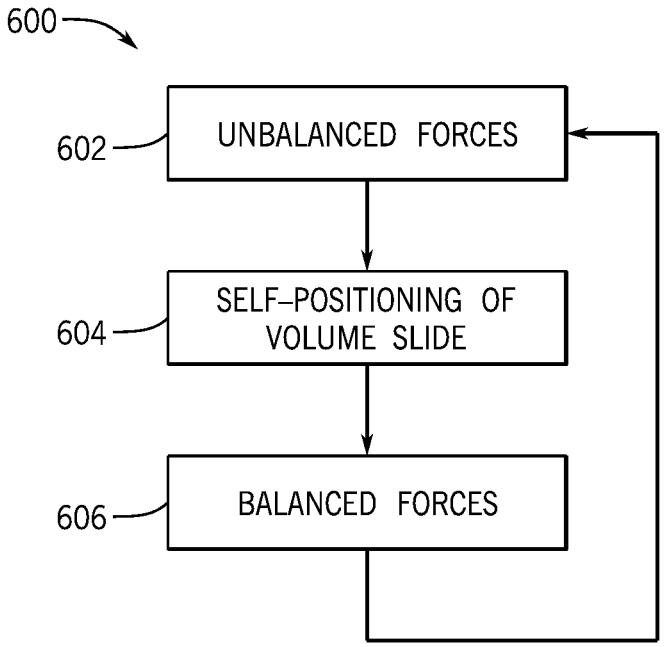
FIG. 13 is a flow diagram of one example of a method of operation of a compressor having a slide valve assembly of the present technology.

FIG. 13 illustrates a flow diagram of one example of a method 600 of operation of a compressor having a slide valve assembly of the present technology, such as slide valve assembly 200 as shown in FIGS. 3-5. Such a slide valve assembly has a slide valve carriage, a volume slide valve member secured to the slide valve carriage and slidably movable longitudinally with respect to the slide valve carriage, and a capacity slide valve mechanism secured to the slide valve carriage and slidably movable longitudinally with respect to the slide valve carriage. The capacity slide valve mechanism can be slidably movable by a controller, and the volume slide valve member can be self-positioning along the axis of movement. The method 600 is applicable to operation of the compressor during any point during operation, including start-up. The method 600 starts at step 602, where the compressor is operating under operation conditions that cause unbalanced forces acting upon the volume slide member, particularly a difference between the discharge pressure and the groove pressure. In some examples of such circumstances, the discharge pressure may be greater than the groove pressure. In other examples of such circumstances, the discharge pressure may be less than the groove pressure. The method proceeds to step 604, which includes adjusting the position of the slide valve member by self-positioning of the slide valve member in response to the unbalanced forces. The slide valve member self-positions by adjusting its position until the groove pressure equals the discharge pressure. In methods of the present technology, there is not an actuator or other position controlling apparatus connected to slide valve member that moves the actuator. Instead, the slide valve member moves solely in response to differences in pressure between the groove pressure and the discharge pressure. When the compressor is operating in under compression, where the discharge pressure is greater than the groove pressure, then the slide valve member may adjust its position by self-positioning in a first direction. When the compressor is operating in over compression, where the discharge pressure is less than the groove pressure, then the slide valve member may adjust its position by self-positioning in a second direction. Once the slide valve member self-positions by adjusting its position until the groove pressure equals the discharge pressure, the method next continues to step 606, which includes operating the compressor under operation conditions where there are balanced forces acting upon the volume slide member. As the compressor continues to operate, other operation conditions may occur that cause the forces acting upon the volume slide member to once again become unbalanced, and the method may go back to step 602.

From the foregoing, it will be appreciated that although specific examples have been described herein for purposes of illustration, various modifications can be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

We claim:

1. A slide valve assembly for use in a compressor, the slide valve assembly comprising:

a slide valve carriage;

a volume slide valve member secured to the slide valve carriage and slidably movable longitudinally with respect to the slide valve carriage, the volume slide valve member being self- positioning along the axis of movement; and a capacity slide valve mechanism secured to the slide valve carriage and slidably movable longitudinally with respect to the slide valve carriage;

wherein the slide valve assembly does not include a rackshaft connected to the volume slide valve member.

2. The slide valve assembly of claim 1, wherein the slide valve assembly does not include an actuator connected to the volume slide valve member.

3. A compressor comprising:

a compressor housing;

a main rotor mounted within the compressor housing; and a slide valve assembly mounted inside the compressor housing that is cooperable with the main rotor, wherein the slide valve assembly includes:

a slide valve carriage;

a volume slide valve member secured to the slide valve carriage and slidably movable longitudinally with respect to the slide valve carriage, the volume slide valve member being self-positioning along the axis of movement to control compressor volume ratio; and a capacity slide valve mechanism secured to the slide valve carriage and slidably movable longitudinally with respect to the slide valve carriage to control compressor capacity;

wherein the slide valve assembly does not include a rackshaft connected to the volume slide valve member.

4. The compressor of claim 3, wherein the compressor is a rotary gas compressor.

5. The compressor of claim 3, wherein the slide valve assembly does not include an actuator connected to the volume slide valve member.

6. A method of operating a compressor having a slide valve assembly, wherein the slide valve assembly includes: a slide valve carriage; a volume slide valve member secured to the slide valve carriage and slidably movable longitudinally with respect to the slide valve carriage, the volume slide valve member being self-positioning along the axis of movement; and a capacity slide valve mechanism secured to the slide valve carriage and slidably movable longitudinally with respect to the slide valve carriage, wherein the slide valve assembly does not include a rackshaft connected to the volume slide valve member, the method comprising:

operating the compressor under operation conditions that cause unbalanced forces acting upon the volume slide valve member;

adjusting the position of the volume slide valve member by self-positioning of the slide valve member in response to the unbalanced forces; and operating the compressor under operation conditions where there are balanced forces acting upon the volume slide valve member.

7. The method of claim 6, wherein the unbalanced forces acting upon the volume slide valve member include a difference between a discharge pressure and a groove pressure.

8. The method of claim 7, wherein self-positioning of the volume slide valve member includes the slide valve member adjusting its position until the groove pressure equals the discharge pressure.

9. A slide valve assembly for use in a compressor, the slide valve assembly comprising:

a slide valve carriage;

a volume slide valve member secured to the slide valve carriage and slidably movable longitudinally with respect to the slide valve carriage, the volume slide valve member being self-positioning along the axis of movement; and a capacity slide valve mechanism secured to the slide valve carriage and slidably movable longitudinally with respect to the slide valve carriage;

wherein the slide valve assembly does not include an actuator connected to the volume slide valve member.

10. The slide valve assembly of claim 9, wherein the slide valve assembly does not include a rackshaft connected to the volume slide valve member.

11. A compressor comprising:

a compressor housing;

a main rotor mounted within the compressor housing; and a slide valve assembly mounted inside the compressor housing that is cooperable with the main rotor, wherein the slide valve assembly includes:

a slide valve carriage;

a volume slide valve member secured to the slide valve carriage and slidably movable longitudinally with respect to the slide valve carriage, the volume slide valve member being self-positioning along the axis of movement to control compressor volume ratio; and a capacity slide valve mechanism secured to the slide valve carriage and slidably movable longitudinally with respect to the slide valve carriage to control compressor capacity;

wherein the slide valve assembly does not include an actuator connected to the volume slide valve member.

12. The compressor of claim 11, wherein the compressor is a rotary gas compressor.

13. The compressor of claim 11, wherein the slide valve assembly does not include a rackshaft connected to the volume slide valve member.

14. A method of operating a compressor having a slide valve assembly, wherein the slide valve assembly includes: a slide valve carriage; a volume slide valve member secured to the slide valve carriage and slidably movable longitudinally with respect to the slide valve carriage, the volume slide valve member being self-positioning along the axis of movement; and a capacity slide valve mechanism secured to the slide valve carriage and slidably movable longitudinally with respect to the slide valve carriage, wherein the slide valve assembly does not include an actuator connected to the volume slide valve member; the method comprising:

operating the compressor under operation conditions that cause unbalanced forces acting upon the volume slide valve member;

adjusting the position of the volume slide valve member by self-positioning of the volume slide valve member in response to the unbalanced forces; and operating the compressor under operation conditions where there are balanced forces acting upon the volume slide valve member.

15. The method of claim 14, wherein the unbalanced forces acting upon the volume slide valve member include a difference between a discharge pressure and a groove pressure.

16. The method of claim 15, wherein self-positioning of the volume slide valve member includes the volume slide valve member adjusting its position until the groove pressure equals the discharge pressure.

* * * * *